US008961866B2

(12) United States Patent
Properzi

(10) Patent No.: US 8,961,866 B2
(45) Date of Patent: Feb. 24, 2015

(54) APPARATUS FOR MELTING AND REFINING IMPURE NONFERROUS METALS, PARTICULARLY SCRAPS OF COPPER AND/OR IMPURE COPPER ORIGINATING FROM THE PROCESSING OF MINERALS

(76) Inventor: Giulio Properzi, Milan (IT)

( * ) Notice: Subject to any disclaimer, the term of this patent is extended or adjusted under 35 U.S.C. 154(b) by 252 days.

(21) Appl. No.: 13/521,370

(22) PCT Filed: Aug. 4, 2011

(86) PCT No.: PCT/EP2011/063418
§ 371 (c)(1),
(2), (4) Date: Jul. 10, 2012

(87) PCT Pub. No.: WO2012/038140
PCT Pub. Date: Mar. 29, 2012

(65) Prior Publication Data

US 2012/0326365 A1 Dec. 27, 2012

(30) Foreign Application Priority Data

Sep. 24, 2010 (IT) ..... MI2010A1741

(51) Int. Cl.

| | |
|---|---|
| ***F27D 3/00*** | (2006.01) |
| ***F27B 3/06*** | (2006.01) |
| ***F27B 3/16*** | (2006.01) |
| ***F27B 3/18*** | (2006.01) |
| ***F27D 1/02*** | (2006.01) |
| ***F27D 3/10*** | (2006.01) |

(52) U.S. Cl.
CPC . *F27B 3/065* (2013.01); *F27B 3/16* (2013.01); *F27B 3/18* (2013.01); *F27D 1/022* (2013.01); *F27D 3/0025* (2013.01); *F27D 3/10* (2013.01)
USPC ..... 266/240; 266/173; 266/242

(58) Field of Classification Search
CPC ..... F27D 3/00; F27D 2003/0089; F27D 2003/0091
USPC ..... 266/242, 173, 240; 432/239, 250
See application file for complete search history.

(56) References Cited

U.S. PATENT DOCUMENTS

| | | | | |
|---|---|---|---|---|
| 2,098,586 | A * | 11/1937 | Marble | 432/251 |
| 3,244,298 | A | 4/1966 | Foard et al. | |
| 2004/0222575 | A1 | 11/2004 | Nishiwaki et al. | |
| 2012/0326365 | A1 * | 12/2012 | Properzi | 266/242 |

FOREIGN PATENT DOCUMENTS

| | | | |
|---|---|---|---|
| GB | 873 295 | A | 7/1961 |
| JP | 48 012286 | B | 4/1973 |
| WO | WO 93/11398 | A1 | 6/1993 |

* cited by examiner

*Primary Examiner* — Scott Kastler
(74) *Attorney, Agent, or Firm* — Foley & Lardner LLP

(57) ABSTRACT

An apparatus for melting and refining impure nonferrous metals, comprising a tiltable reverberatory furnace with a furnace body that has a base with a rectangular plan shape and is provided with two mutually opposite heads, which are mutually connected by a bottom wall, by an upper wall or ceiling and by two side walls, the furnace being provided with means for the tilting of the furnace body about an axis which is substantially horizontal and perpendicular to the heads; the furnace has, in a central region of the upper wall, a portion that protrudes upwardly from the remaining portion of the upper wall and is delimited in an upper region by a flying buttress-like wall and laterally by two mutually opposite side walls, the portion having, on the side that faces the flying buttress-like wall, a loading port, which is closed by a movable door.

8 Claims, 6 Drawing Sheets

APPARATUS FOR MELTING AND REFINING IMPURE NONFERROUS METALS, PARTICULARLY SCRAPS OF COPPER AND/OR IMPURE COPPER ORIGINATING FROM THE PROCESSING OF MINERALS

CROSS REFERENCE TO RELATED APPLICATIONS

The present application is a US National Stage of International Application No. PCT/EP2011/063418, filed Aug. 4, 2011, designating the United States, and claiming priority to Italian Patent Application No. MI2010A001741, filed Sep. 24, 2010.

TECHNICAL FIELD

The present invention relates to an apparatus for melting and refining impure nonferrous metals, particularly scraps of copper and/or impure copper originating from the processing of minerals.

BACKGROUND ART

As is known, the recycling of copper is very important because it is a metal whose natural resources are rather scarce and thus it has high price, and because of the energy and environmental advantages that are obtained.

Copper scraps are marketed all around the world, selected according to their origin and their content of pure copper.

For example, the following types of copper scraps are marketed:

- Berry (First class), which consists of old and new cables made of pure non-tinned copper with a minimum of 99% Cu.
- Clove, i.e., electric wires made of pure copper in granulate form with a minimum of 99% Cu.
- Kanal, pure copper wires with a minimum content of Cu equal to 98%.
- Birch, copper wires with welds and Cu content equal to 93-95%.
- Candy (Second class)—telephone wires, copper plates, pipes with paint and paper. 95-96% Cu content.
- Dream (Third class)—mixed scraps of unalloyed copper, with 92-93% Cu content.

Such scraps may be recycled for electrical uses directly by fire refining.

Scraps with lower Cu content are melted and fire refined to produce anodes that are converted into cathodes by electrolysis in a subsequent treatment, or for the formation of alloys.

Both the melting operation and the refining operation are usually performed with reverberatory furnaces, with liquid or gaseous fuels, of the tank or tiltable type.

The uses of copper can be divided in two large categories: electrical and non-electrical. The former are the most important in economical and volume terms and require copper with high conductivity and therefore high purity (99.95% Cu).

The background art indicates, as starting material for producing electric wires, copper in form of cathodes obtained by electrolysis and thus 99.99% pure and with a conductivity above 101 IACS.

The cathodes are melted continuously in well-known tower furnaces or shaft furnaces (for example of the type disclosed in U.S. Pat. No. 3,199,977) and the like, which feed continuous casting and rolling plants in order to obtain so-called "ETP" rod coils in diameters comprised between 8 mm and 25 mm.

The rod is then cold-drawn in countless wires with different diameters, stranded and/or coated with insulator in order to obtain the desired wires. The rod may be also drawn or rolled in strips and shaped elements and may also be extruded continuously by using the Conform method.

Besides this technology, which meets most of the market needs, there is also a method for manufacturing rod for electrical uses that starts from scraps with a minimum Cu contents of 92%. Such rod is called FRHC (Fire Refined High Conductivity) and has characteristics that are almost identical to ETP rod.

This last method is based on a reverberatory furnace for the melting and refining of scrap, such operations being performed over 16 hours, while in the remaining 8 hours of the day the furnace feeds a casting and rolling line.

The reverberatory furnace for the above mentioned uses is a tank furnace, which can vary between less than 50 t and more than 400 t.

Such furnace is also used for the production of anodes for which it is loaded both with scraps and with Blister copper.

Such type of furnace, illustrated in FIGS. 1 to 3, has a furnace body 1 with a parallelepipedal shape with two mutually opposite heads 2, 3, or short sides, arranged along substantially vertical planes and mutually connected by a bottom wall 4, by an upper wall or ceiling 5 and by two side walls 6, 7. Such furnaces are provided with one or two burners 8 on a head 2 and with an outlet 9 for the exhaust gases to be connected to a stack on the opposite head 3. On one side wall 6 and in a central region one or two loading ports 10 are provided, which are closed by a corresponding movable door 11, while toward the end that is near to the outlet 9 for the exhaust gases, on the same side wall 6, a small door or deslagging door 12 is arranged which allows deslagging, i.e., the extraction of the slag 22 that floats on the bath 15 of molten metal.

On the other side wall 7 the casting spout 13 and the system of so-called "tuyeres" are provided, i.e., pipes 14 that supply both compressed air for oxidizing the bath 15 and fuel for deoxidizing the bath 15.

The whole furnace body 1, which is constituted by an outer structure 16 made of welded steel and by the inner refractory lining 17, can tilt about its own longitudinal axis 1*a*, which is horizontal and parallel to the longer sides of the furnace body 1, being provided, in the lower portion, with two or three crescent-shaped cradles 18, which can roll on a plane or on a system 19 of wheels or rollers. The oscillation of the furnace body 1 about the axis 1*a* is achieved by means of hydraulic cylinders 20, which are interposed between the furnace body 1 and the footing 21 that supports it.

The maximum rotation in order to empty the furnace, i.e., toward the side of the casting spout, is about 25°-30°, while the rotation in the other direction to facilitate deslagging is 5°-7°.

Another less used configuration is the one that provides for the lack of rolling cradles. In this case, tilting occurs about an horizontal axis on which two spherical joints or bearings are placed which are connected to the base of the furnace and are arranged on two strong supports; powerful hydraulic pistons, connected to the other side of the furnace in a suitable position, allow the movement of the furnace.

In order to withstand the aggression of oxygen, of oxides and of slag components it is necessary to use magnetite refractory, which however is sensitive to thermal shock and has a considerable linear expansion at high temperatures (even 10 cm for 10 meters of wall).

Due to these characteristics of the refractory and due to the movements necessary during the working cycle, particular care must be given to the structure of the walls and roof of the furnace.

In this type of furnace, a mix of scraps, loose, in bales or as blocks of blister copper, is loaded intermittently through the loading port and is simultaneously melted. For economic reasons, loose scrap is preferred in spite of the difficulties in handling.

This operation may last 6 to 18 hours and is very laborious; both with four-wheel frontal loaders with diesel engines and with expressly designed loading machines, insertion of the material is delicate both because the jambs of the door must not be damaged, both because each charge is limited in weight for the volumes of the loaded material, and because the charge must be distributed in the tank of the furnace, preventing it from accumulating only proximate to the door.

A first deslagging is then performed and one proceeds to the refining step.

Basic refining is performed by injecting air, i.e., oxygen which combines with the pollutant metals, forming oxides that float as slag and are then extracted from the bath. Each operator then adds other refining methods with the use of specific additives in order to extract rapidly particular pollutants such as Pb—Sn—Ni and others from the bath.

The last operation is the reduction of the oxygen content that is performed by injecting fuel from the tuyeres.

Once the desired level of oxygen has been stabilized and the last deslagging has been completed, one proceeds with casting, which can be aimed at obtaining anodes or continuous rod.

The most important limitations of this type of furnace are the difficult insertion of the scraps and the low thermal efficiency for copper melting; limitations set by the very geometry of the furnace.

In order to overcome such limitations, some types of furnace have been provided, both for primary metal and for impure metal or scrap, which combine some characteristics of the reverberatory tank furnace and some characteristics of the vertical furnace disclosed in U.S. Pat. No. 3,199,977 by A. J. Phillips et al. dated 1965, better known as tower furnace or vertical Asarco furnace, known as "shaft" furnace.

A combination of vertical furnace and tank reverberatory furnace is disclosed by E. De Bie in U.S. Pat. No. 3,715,203 dated 1973 and in Italian Patent IT-995947 by Giulio Properzi.

Furnaces known as Striko or the like have been in use already for a long time; however, the difficulty of melting impure copper or scrap with a Cu contents of less than 97% in a vertical or quasi-vertical furnace has not been overcome, because the slag that forms adheres to the refractory and blocks the lower outlet.

Small furnaces of the combined vertical-tank type under 50 t have been proposed, but to the detriment of the possibilities of tilting in both directions, which instead are very useful for the refining and casting operations.

It has been noted over time that the impure metal must be poured with its slag directly onto a large bath of molten metal, where the slag floats and can be extracted with the usual deslagging operations. The molten metal bath must have the maximum surface that complies with practicality criteria, because the thermal/chemical refining phenomena are linear with the surface of the bath; i.e., the greater the surface, the higher and faster the refining. Some attempts to arrange a turret acting as a vertical furnace above the ceiling of a classic reverberatory furnace have not yielded good results, because the turret fails both statically and during tilting and also due to excessively difficult loading.

DISCLOSURE OF THE INVENTION

The aim of the present invention is to solve the problems described above, providing an apparatus for melting and refining impure nonferrous metals, particularly scraps of copper and/or impure copper originating from the processing of minerals, which comprises a tiltable reverberatory (tank) furnace, which allows the insertion, at every opening of the loading door, of scraps or other charge material in a quantity substantially greater than the one allowed by conventional reverberatory furnaces.

Within this aim, an object of the invention is to provide an apparatus that creates conditions that are less exposed to heat and to reverberation for the operators assigned to loading.

Another object of the invention is to propose an apparatus that makes it possible to have more space inside the furnace in order to deposit therein a large quantity of scraps and other charge material, so as to increase flame-scraps contact and thus optimize heat exchange and thus energy efficiency and consequently reduce melting times.

Another object of the invention is to provide an apparatus that makes it possible to reduce the number of single loading operations and the opening times of the loading door.

This aim and these and other objects that will become better apparent hereinafter are achieved by an apparatus for melting and refining impure nonferrous metals, particularly scraps of copper and/or impure copper originating from the processing of minerals, comprising a tiltable reverberatory furnace with a furnace body that has a base with a rectangular plan shape and is provided with two mutually opposite heads, which are mutually connected by a bottom wall, by an upper wall or ceiling and by two side walls, means being provided for the tilting of said furnace body about an axis which is substantially horizontal and perpendicular to said heads, characterized in that it has, in a central region of said upper wall, a portion that protrudes upward from the remaining portion of said upper wall and is delimited in an upper region by a flying buttress-like wall, laterally by two opposite side walls, and has, on the side that faces said flying buttress-like wall, a loading port, which is closed by a door movable to open and close said loading port.

BRIEF DESCRIPTION OF THE DRAWINGS

Further characteristics and advantages of the invention will become better apparent from the analysis of the description that follows, made with reference to the accompanying drawings, which illustrate a conventional tiltable reverberatory furnace and a preferred but not exclusive embodiment of the apparatus according to the invention, more particularly.

WAYS OF CARRYING OUT THE INVENTION

Figure 1:
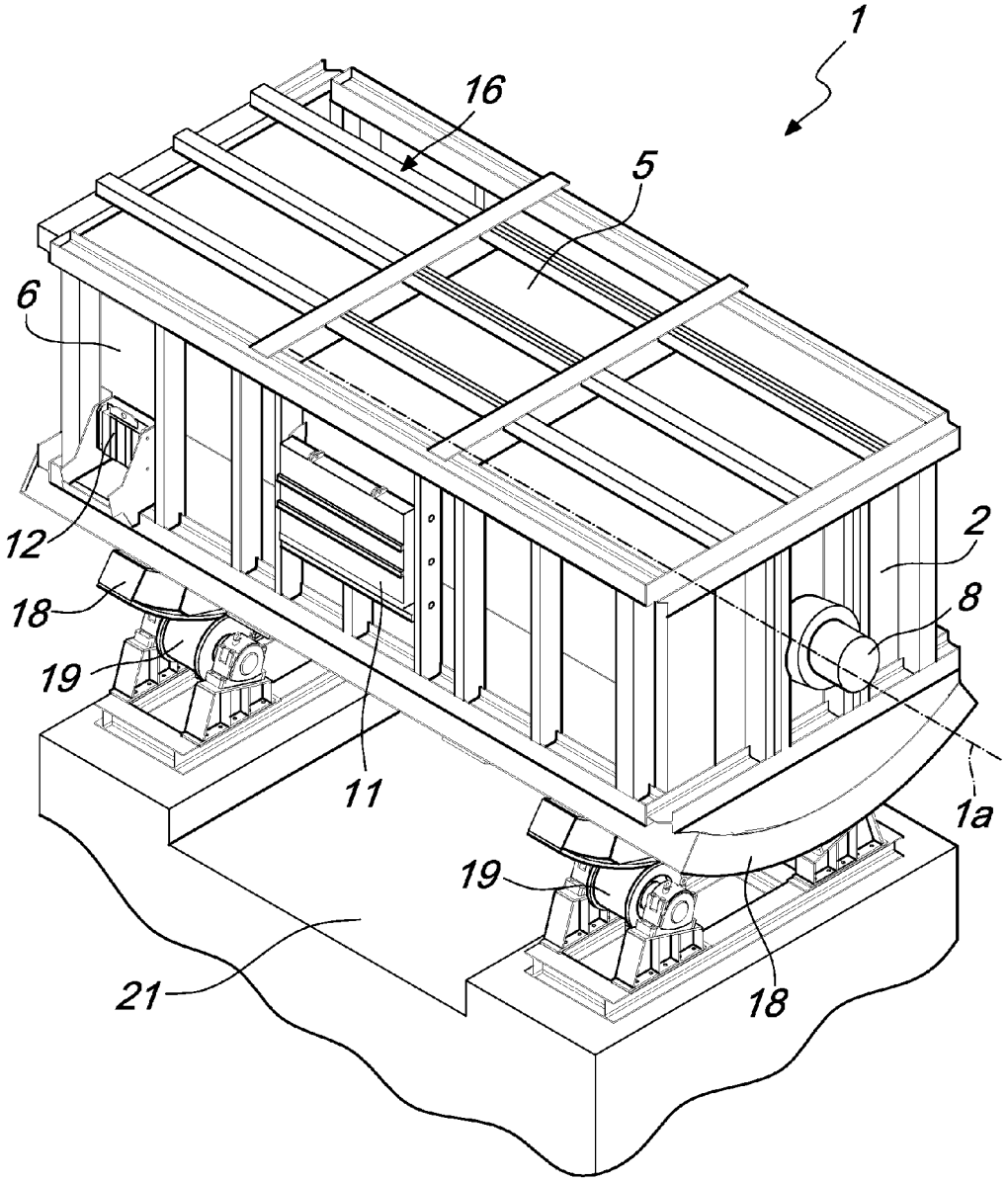
Fig. 1 PRIOR ART
FIG. 1 is a perspective view of a conventional tiltable reverberatory furnace.
Figure 2:
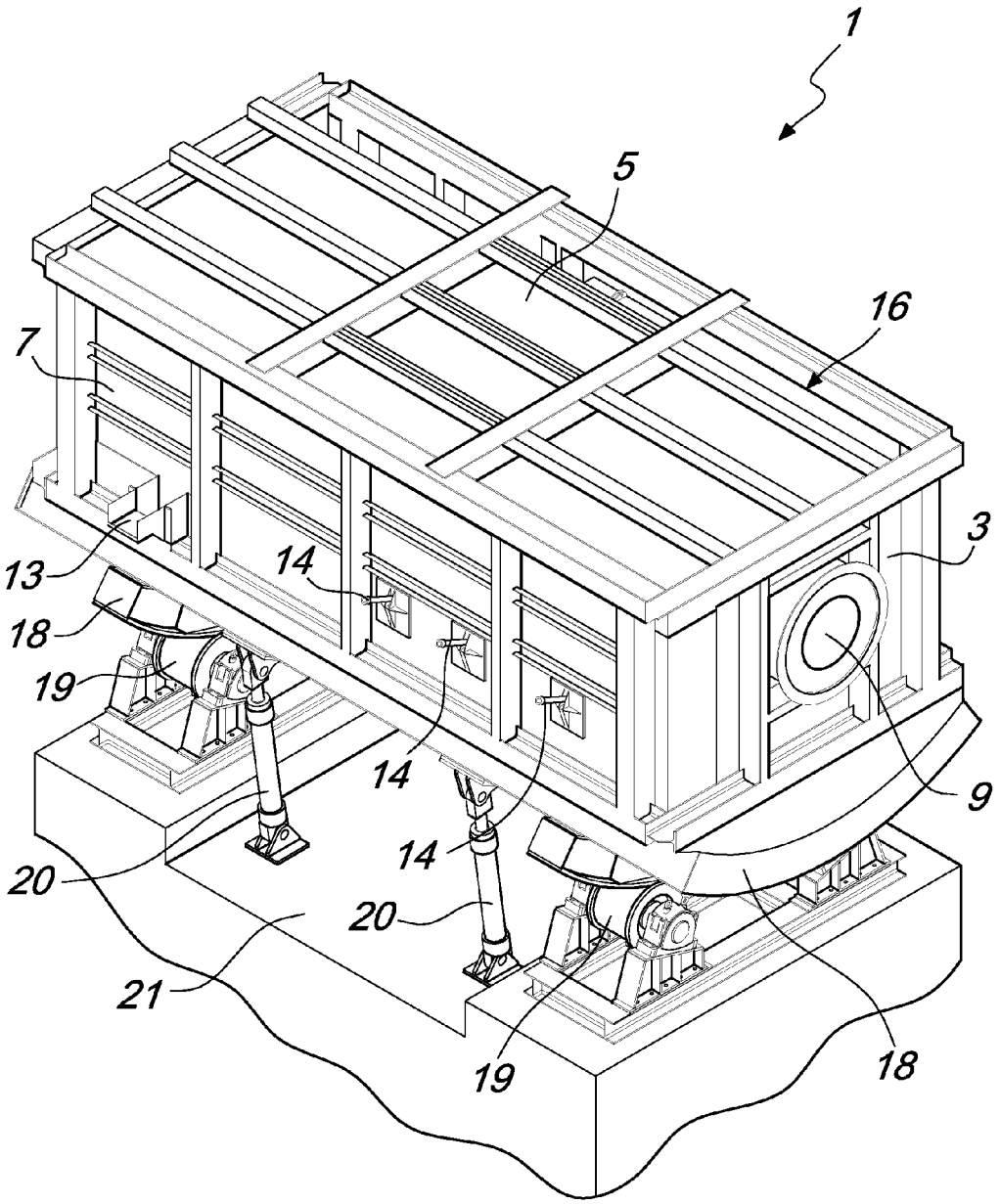
Fig. 2 PRIOR ART
FIG. 2 is again a perspective view of the furnace in FIG. 1, but taken from a different angle.

FIGS. 1 and 2 are views, taken from the two sides 6 and 7 or long sides, of a conventional tiltable reverberatory furnace. The furnace body 1 rests on crescent-shaped cradles 18 and tilts on wheels 19, being moved by hydraulic cylinders 20. A burner 8 applied to a head 2 provides thermal energy. The exhaust gases exit from the outlet for the exhaust gases 9 defined in an opposed head 3. Tuyeres 14 allow the injection of air or nitrogen or fuel in the bath according to the needs of the refining process. A loading port 10 is closed by a corresponding door 11, which is movable in order to allow the loading of the furnace. The reference numeral 12 designates the deslagging door. A casting spout 13 makes it possible to discharge the molten and refined metal.

Figure 3:
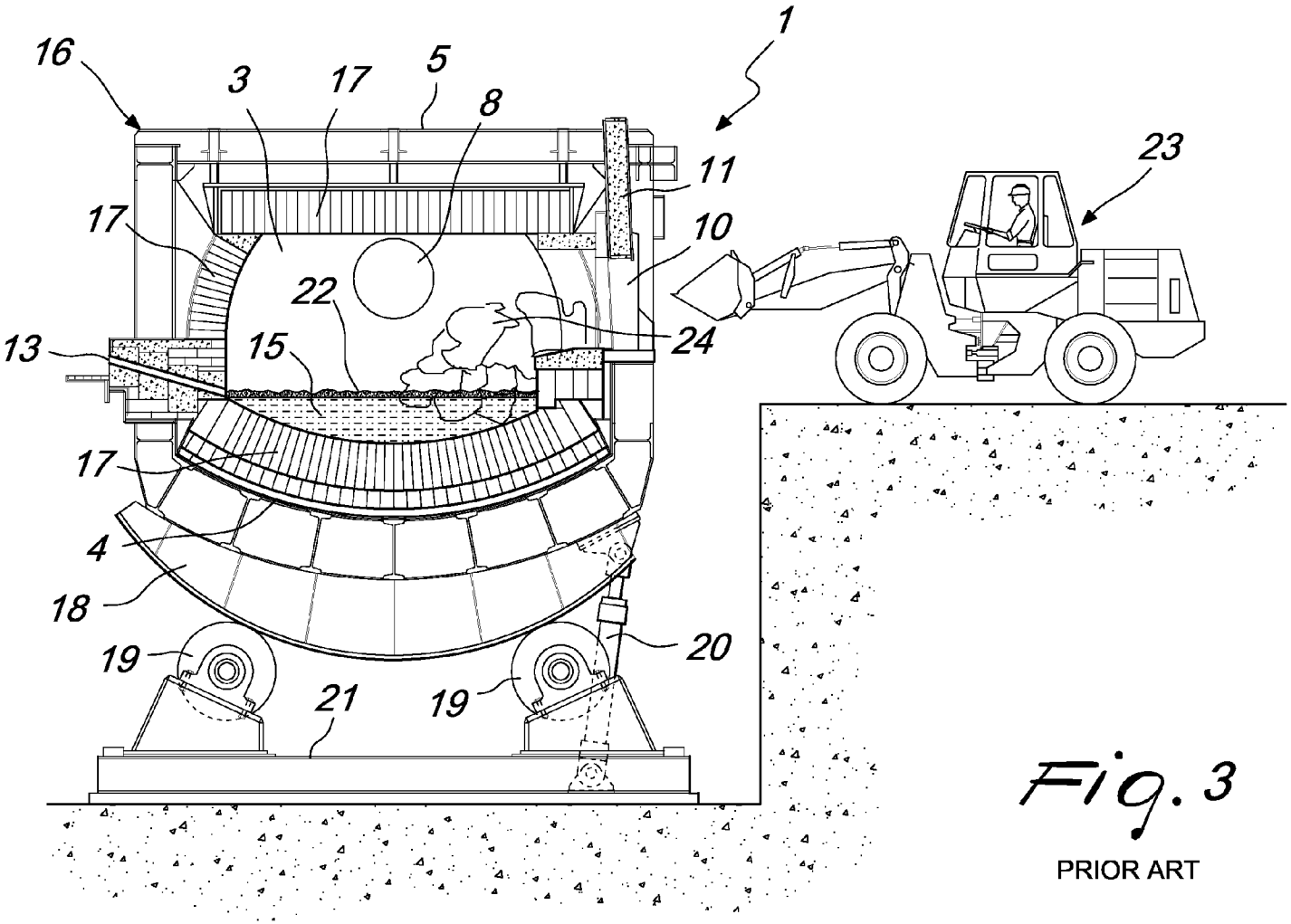
Fig. 3 PRIOR ART
FIG. 3 is a transverse central sectional view of the furnace of FIG. 1.

FIG. 3 is a central sectional view of the same furnace with the door 11 open, showing a loading machine 23, the loading port 10, the door 11, a structure 16 made of steel, a refractory lining 17, a bath 15 of molten metal, slag 22, scraps or other charge material 24, the burner 8 and the casting spout 13.

As can be seen, loading is not easy and the volume of the scrap exposed to the flame is limited.

Figure 4:
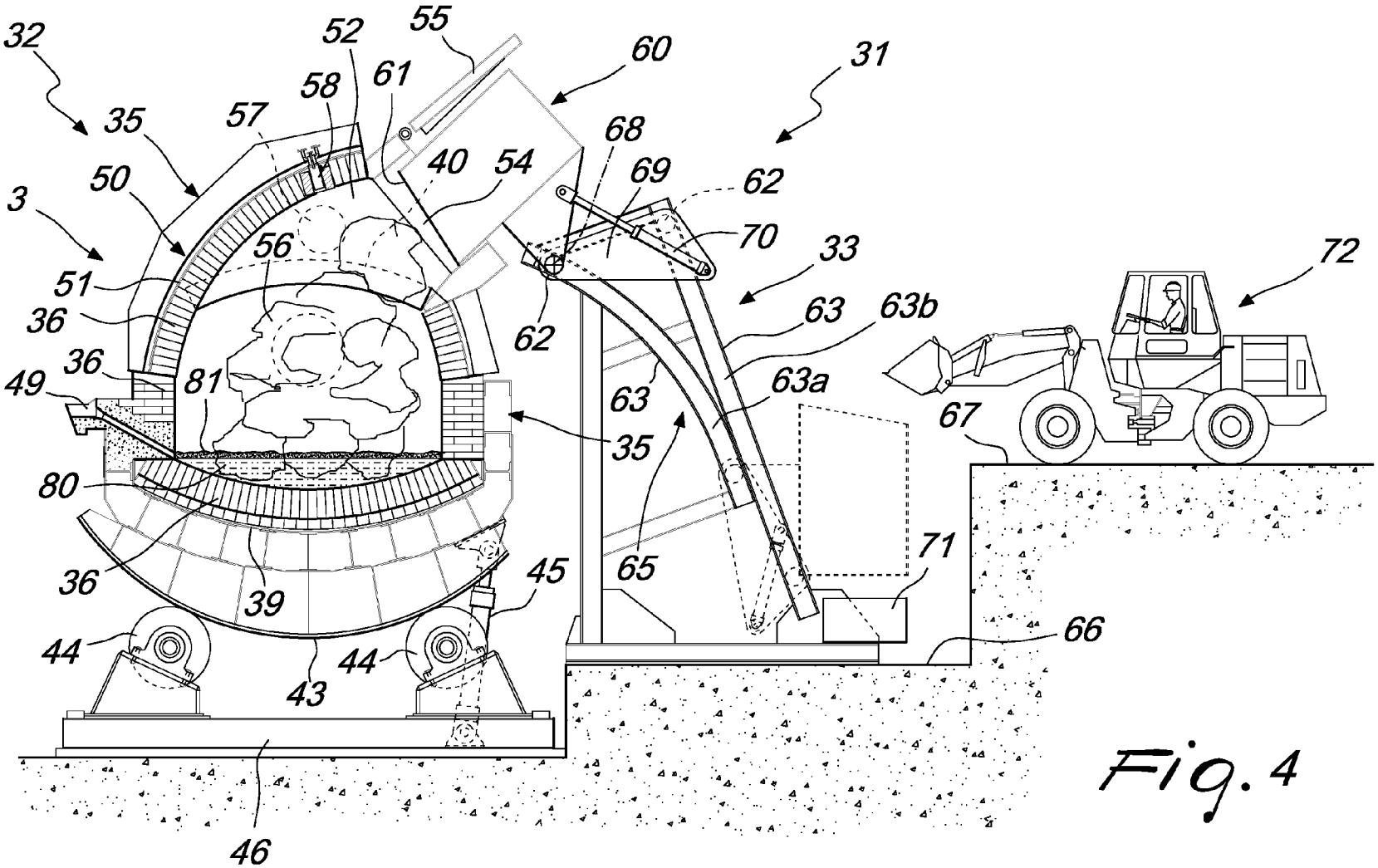
FIG. 4 is a view of the apparatus according to the present invention, with the furnace in cross-section along a transverse central plane, during the loading operation.
Figure 5:
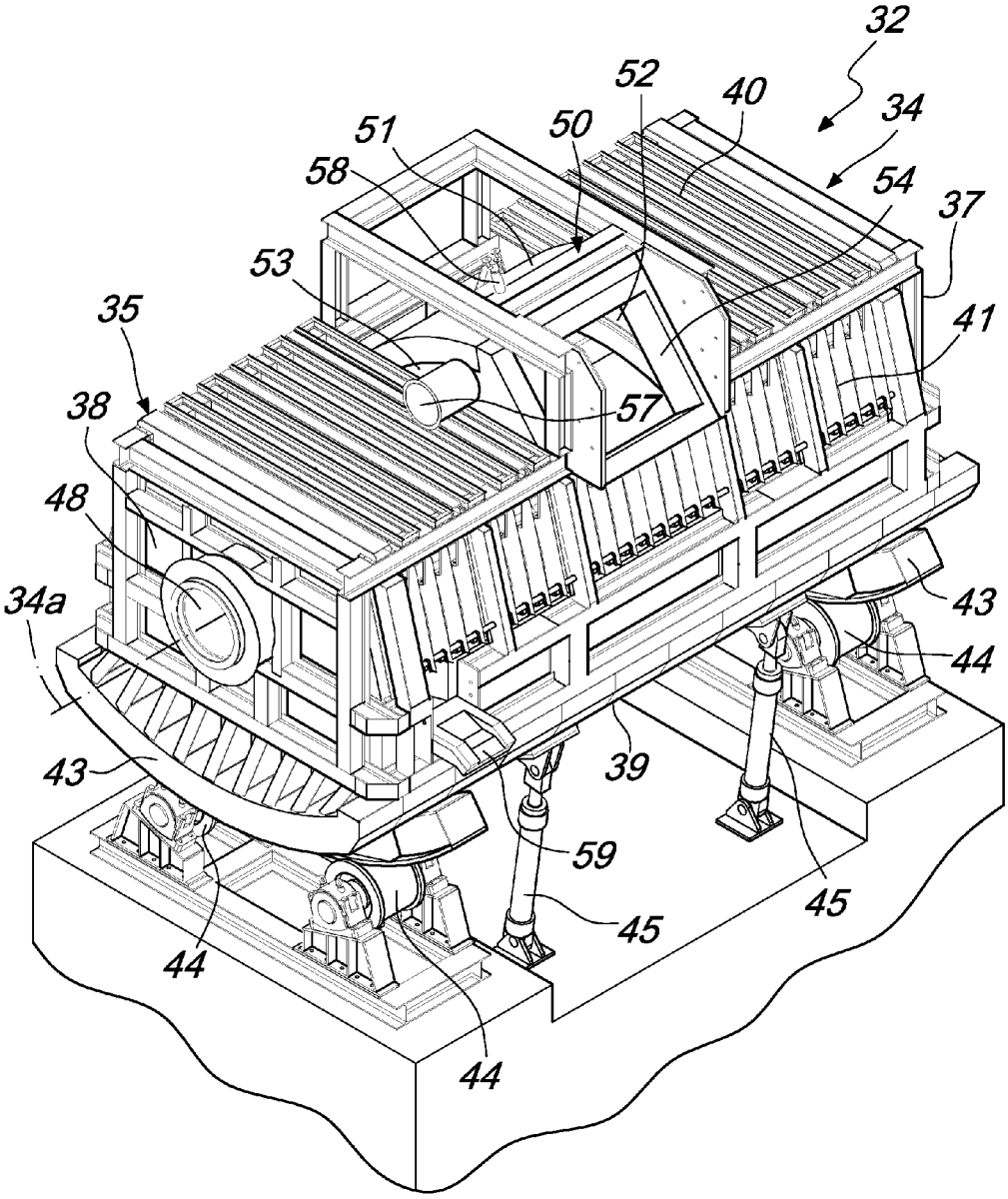
FIG. 5 is a perspective view of the furnace of the apparatus according to the invention with the door of the loading port omitted for the sake of clarity.
Figure 6:
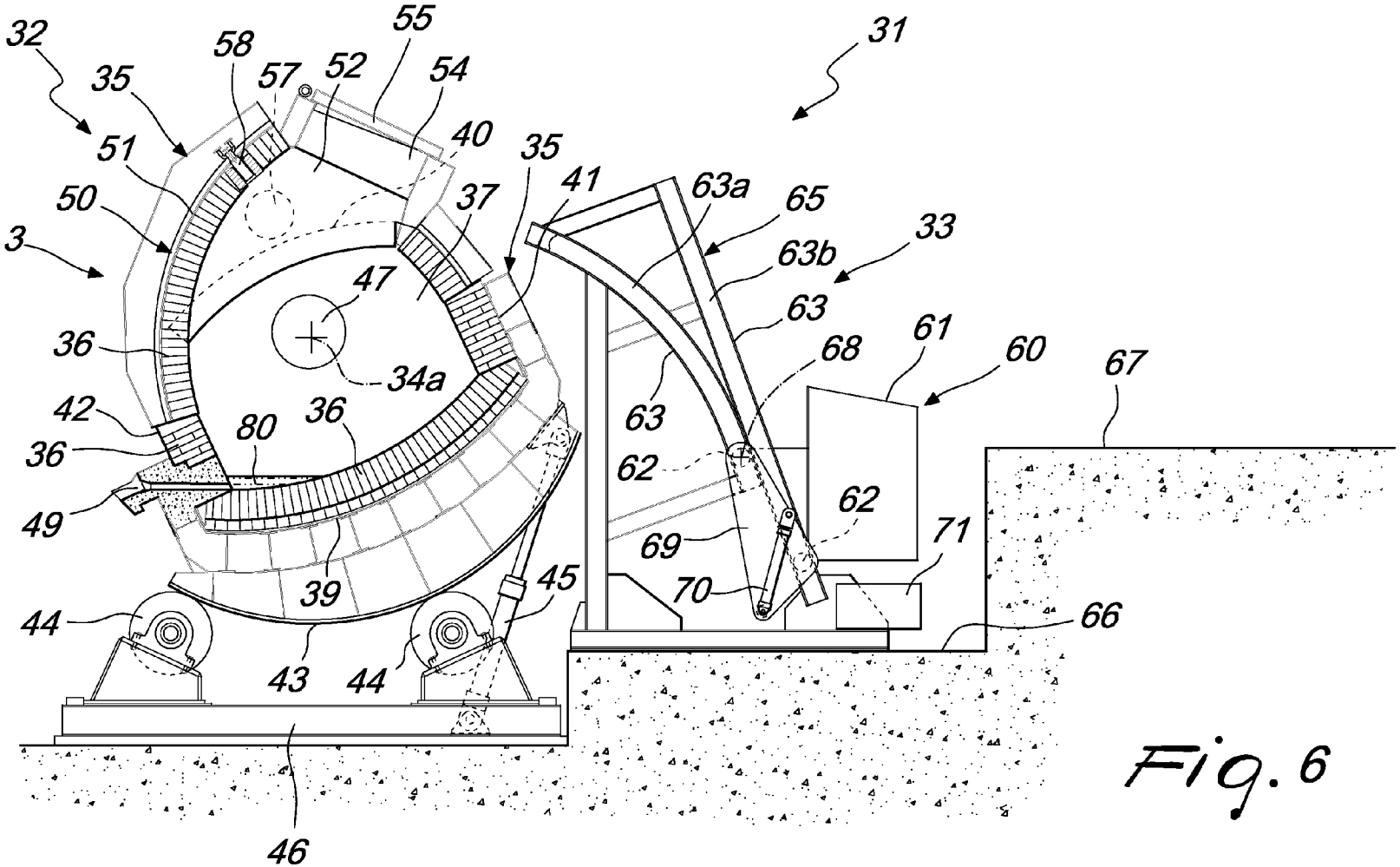
FIG. 6 is a view of the apparatus according to the invention with the furnace in cross-section along a transverse central plane, during the casting operation.

With reference to FIGS. 4 to 6, the apparatus according to the invention, generally designated by the reference numeral 31, comprises a tiltable reverberatory furnace 32 and a loader 33.

The furnace 32 comprises a furnace body 34 composed of an outer structure 35 made of steel and an inner refractory lining 36.

The furnace body 34 has a base with a rectangular plan shape and is provided with two mutually opposite heads 37, 38, which are mutually connected by a bottom wall 39, by an upper wall or ceiling 40 and by two side walls 41, 42.

The furnace 32 is further provided with tilting means, which can be actuated in order to impart an oscillation to the furnace body 34 about its longitudinal axis 34*a*, which is substantially horizontal and perpendicular to the plane of arrangement of the heads 37, 38.

More precisely, the furnace body 34 is provided, in its lower portion, with crescent-shaped cradles 43, which rest, like the conventional tiltable reverberatory furnaces, on a system of wheels or rollers 44. The tilting means are constituted by hydraulic cylinders 45, which connect the furnace body 34 to a footing 46 that supports it and can be actuated in order to cause the oscillation of the furnace body 34 about an axis 34*a* with respect to the footing 46.

At least one main burner 47 is mounted on the head 37 in a manner known per se, while on the opposite head 38 an outlet for the exhaust gases 48 is provided.

On the side wall 42 there are a casting spout 49 and the system of tuyeres, not visible in FIGS. 4 to 6, provided in the same manner as in conventional tiltable reverberatory furnaces.

On the side wall 41, proximate to the head 38, a deslagging door 59 is provided, similarly to conventional tiltable reverberatory furnaces.

According to the invention, the furnace body 34 has, in a central region of the upper wall 40, a portion 50 that protrudes upwardly from the remaining portion of the upper wall 40 and is delimited in an upper region by a flying buttress-like wall 51, laterally by two side walls 52, 53, and has, on the side that faces the flying buttress-like wall 51, a loading port 54, which is closed by a door 55 movable on command to open or close the loading port 54.

In practice, the furnace body 34 according to the invention is provided with a central turret, of the dormer-window or mansard-roof type in architectural terms, delimited by four sides, of which one is constituted by the flying buttress-like wall 51, two are constituted by the side walls 52, 53 and the fourth side is constituted in whole or in part by the loading port 54 and by its door 55.

The radius of curvature of the flying buttress-like wall 51 is so wide that, despite maintaining a structure that is capable of withstanding tilting about the axis 34*a* with an oscillation breadth of 25° and more, makes it possible to place the entire loading port 54 higher than the opposite wall, which is dimensioned as in conventional tiltable reverberatory furnace, so that the quantity of scrap 56 or other charge material exposed to the flame may be three to five times the quantity of scrap exposed to the flame in conventional tiltable reverberatory furnaces.

The flying buttress-like wall 51, as well as the side walls 52, 53 and the door 55, are conveniently lined on their inner side by a layer of refractory material like the other walls that delimit the inside of the furnace body 34.

More precisely, the presence of the portion 50 and its particular shape allow the arrangement of the loading port 54 not on a side wall, as occurs in conventional tiltable reverberatory furnace, but above the side walls of the furnace body 34.

Conveniently, the loading port 54 lies on a plane that is inclined toward the inside of the body of the furnace 34 with respect to the adjacent side wall 41 of the furnace body 34.

Advantageously, one of the two side walls that delimit the portion 50, in the case illustrated the side wall 53, is provided with an additional outlet 57 for the exhaust gases.

The outlet 48 for the exhaust gases and the additional exhaust gas outlet 57 are preferably connected to a stack by means of respective valves so as to allow independent exhaust gas draft adjustment.

The presence of the additional exhaust gas outlet 57 connected to the stack, the draft of which minimizes the need for a hood above the door 55, attracts the hot gases produced by the burner or by the main burners 47 arranged on the head 37, forcing them to flow along the heap of introduced scrap 56, increasing the thermal exchange.

Preferably, proximate to the top of the flying buttress-like wall 51 an additional burner 58 is provided, which is adapted to strike with a direct flame the scrap or other charge material 56 introduced in the furnace. The presence of the additional burner 58 also increases heat exchange for the heating of the scrap or other charge material 56.

The apparatus according to the invention also comprises a loader 33 composed of a box-like container 60 provided with a loading-unloading opening 61 and with wheels 62 that can engage rails 63 that define a ramp-like path 65 located outside the tilting space of the furnace 32. The ramp-like path 65 extends upwardly from a base plane 66 up to the vicinity of the loading port 54. The box-like container 60 can move along the ramp-like path 65 from a loading position, in which it is arranged proximate to the base of the ramp-like path 65 with its loading-unloading opening 61 directed upward proximate to a loading plane 67, to an unloading position, in which it is arranged proximate to the top of the ramp-like path 65 and is tilted with its loading-unloading opening 61 onto the loading port 54.

More particularly, the body of the box-like container 60 is hinged, about a horizontal axis 68, to a base 69 provided with wheels 62 that engage the rails 63, which are composed of a curved portion 63*a* flanked by a straight portion 63*b*. The wheels 62 of the base 69 are composed of at least two pairs of wheels, of which a first pair engages the curved portion 63*a* and a second pair engages the straight portion 63*b*. The shape of the rails 63 and their mutual arrangement is such as to obtain, during the transition of the box-like container 60 from the loading position to the unloading position, a partial tipping of the box-like container 60. Such partial tipping is completed by tipping means constituted by a hydraulic cylinder 70, which is interposed between the base 69 and the body of the box-like container 60 and causes the rotation of the box-like container 60 about the axis 68 with respect to the base 69.

The movement of the box-like container 60 along the ramp-like path 65 may be performed, for example, in a manner known per se, by means of a motor 71 or hydraulic cylinders or other movement means of a known type.

Operation of the apparatus according to the invention is as follows.

With the box-like container 60 arranged in the loading position, the scrap or other material 56 to be conveyed into the furnace 32 can be introduced easily inside the box-like container 60 by means of conventional loading machines 72, such as for example cranes, front loaders, fork-lifts that move along the loading plane 67. It should be noted that the operation of filling the box-like container 60 occurs in a region that is rather distant from the loading port 54 of the furnace 32 and thus adequately shielded from the heat and from reverberation. This allows the operators to work in acceptable and safe environmental conditions.

Once full, the box-like container 60 is lifted along the ramp-like path 65 until its loading-unloading opening 61 is proximate to the loading port 54 of the furnace 32, opened beforehand, onto which it is tilted, pouring into the furnace 32 its charge of scrap or other material 56, forming a large accumulation of material that is exposed directly to the flame, achieving a high thermal/energy efficiency for the furnace.

Such thermal efficiency may be further increased by actuating the additional burner 58, which directs the generated hot gases downwardly in an almost vertical direction, passing through the entire charge of material 56 before venting into the exhaust gas outlet 48 and/or into the additional exhaust gas outlet 57.

It should be noted that the door 55 arranged at the loading port 54 of the furnace remains open for an extremely reduced time with respect to the time required in conventional furnaces, since with the furnace according to the invention it is no longer necessary to push and distribute the charge of material inside the furnace.

The progressive melting of the material introduced in the furnace generates a bath 80 of molten metal covered by a layer of slag 81. The furnace may be inclined up to an angle of 30° with respect to the vertical, as shown in FIG. 6, in order to discharge the molten metal through the casting spout 49, and approximately by 7° in the opposite direction in order to discharge the slag 81 through the deslagging door 59.

In practice it has been found that the apparatus according to the invention fully achieves the intended aim and objects, since the particular geometry of the furnace with the arrangement of the loading port at a considerably higher level than conventional tiltable reverberatory furnaces makes it possible to speed up the furnace loading operations and to introduce a significantly greater quantity of scrap or other material, increasing the surface of heat exchange between the flame and the charge material and thus achieving higher energy efficiency and consequently a reduction in melting times with respect to conventional tiltable reverberatory furnaces.

A further advantage of the apparatus according to the invention is that it can use a box-like loader capable of loading automatically considerable quantities of material, as an indication 5 t to 10 t at a time, in short times, so as to not exceed 40 operations to complete the loading of the furnace.

Another advantage of the apparatus according to the invention is to create less onerous working conditions for the operators assigned to loading the furnace.

The apparatus thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. MI2010A001741 from which this application claims priority are incorporated herein by reference.

The invention claimed is:

1. An apparatus for melting and refining impure nonferrous metals originating from processing of minerals, comprising a tiltable reverberatory furnace with a furnace body that has a base with a rectangular plan shape and is provided with two mutually opposite heads, which are mutually connected by a bottom wall, by an upper wall or ceiling and by two side walls, the apparatus comprising a tilting device adapted to tilt said furnace body about an axis which is substantially horizontal and perpendicular to said heads, further comprising, in a central region of said upper wall, a portion that protrudes upwardly from the remaining portion of said upper wall and is delimited in an upper region by a flying buttress wall, laterally by two mutually opposite side walls, and having, on the side that faces said flying buttress wall, a loading port, which is closed by a door movable to open and close said loading port.

2. The apparatus according to claim 1, wherein said loading port is arranged above the side walls of the body of the furnace.

3. The apparatus according to claim 1, wherein said loading port lies on a plane which is inclined toward the inside of the body of the furnace with respect to the adjacent side wall of the body of the furnace.

4. The apparatus according to claim 1, wherein on one of said heads there is at least one main burner and on another one of said heads there is an outlet for the exhaust gases, on one side wall of said side walls, an additional outlet being defined for the exhaust gases.

5. The apparatus according to claim 4, wherein said outlet for the exhaust gases and said additional exhaust gas outlet are connected to a stack by valves for independent draft adjustment.

6. The apparatus according to claim 1, further comprising an additional burner, which is arranged proximate to the top of said flying buttress wall and is adapted to strike with a direct flame the load of material introduced in said furnace.

7. The apparatus according to claim 1, further comprising a loader which comprises a box container with a loading-unloading opening and is provided with wheels engageable with rails arranged along a ramp path located outside the tilting space of the furnace, said ramp path being extended upward from a base plane to said loading port and said box container being movable along said ramp path from a loading position, in which it is arranged proximate to a base of said ramp path with its loading-unloading opening directed upward proximate to a loading plane, to an unloading position, in which it is arranged proximate to the top of said ramp path and is tilted with its loading-unloading opening onto said loading port.

8. The apparatus according to claim 7, further comprising a device for tilting said box container about a horizontal axis along said ramp path.

* * * * *